US008662035B1

(12) United States Patent
Hendriksma

(10) Patent No.: US 8,662,035 B1
(45) Date of Patent: Mar. 4, 2014

(54) OIL PRESSURE CONTROL SYSTEM FOR SWITCHABLE VALVE TRAIN COMPONENTS

(71) Applicant: GM Global Technology Operations LLC, Detroit, MI (US)

(72) Inventor: Nick John Hendriksma, Grand Rapids, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/713,387

(22) Filed: Dec. 13, 2012

(51) Int. Cl.
*F01L 9/02* (2006.01)

(52) U.S. Cl.
USPC ..... 123/90.12; 123/90.13; 123/90.33; 91/392; 251/118

(58) Field of Classification Search
USPC ..... 123/90.12, 90.13, 90.33; 91/392; 251/118
See application file for complete search history.

(56) References Cited

U.S. PATENT DOCUMENTS

| | | | | |
|---|---|---|---|---|
| 6,439,176 | B1 | 8/2002 | Payne et al. | |
| 6,644,265 | B2 | 11/2003 | Parker et al. | |
| 6,758,175 | B2 | 7/2004 | Dinkel et al. | |
| 6,817,325 | B2 | 11/2004 | Dinkel et al. | |
| 7,156,058 | B1 * | 1/2007 | Lou | 123/90.12 |
| 7,946,262 | B2 | 5/2011 | Borraccia et al. | |

* cited by examiner

*Primary Examiner* — Ching Chang
(74) *Attorney, Agent, or Firm* — Cantor Colburn LLP

(57) ABSTRACT

An oil control valve is disposed in fluid communication between an oil supply gallery and an oil control gallery of an oil control system. The oil control valve has a first position that prevents flow of oil from the oil supply gallery to the oil control gallery and permits flow of oil from the oil control gallery to a downstream drain line, and a second position that permits flow of oil from the oil supply gallery to the oil control gallery and prevents flow of oil from the oil supply gallery to the drain line. An oil bypass passage is disposed in fluid communication between the oil supply gallery and the oil control gallery, and is disposed to bypass the oil control valve. The oil bypass passage has first and second oil flow constriction regions, and an intermediate volume disposed between the first and second oil flow constriction regions.

17 Claims, 3 Drawing Sheets

OIL PRESSURE CONTROL SYSTEM FOR SWITCHABLE VALVE TRAIN COMPONENTS

FIELD OF THE INVENTION

The subject invention relates to an oil pressure control system for an internal combustion engine, and more specifically to an oil pressure control system for switchable valve train components of an internal combustion engine.

BACKGROUND

One or more cylinders of a large internal combustion engine, such as a "V8" engine, may be withdrawn from firing service in order to enhance fuel efficiency under low-demand conditions by de-activating the valve train leading to preselected cylinders of the engine. De-activation of the valve train may be accomplished in a variety of ways, such as by using special valve lifters having internal locks that may be switched off either electronically or hydraulically, or by using a two-step valve lift arrangement having a common oil supply for the hydraulic tappets and the switchable rocker arms, or by using any other cylinder deactivation system suitable for a purpose disclosed herein employing cylinder deactivation lifters. Such switching may be accomplished using a hydraulic manifold, referred to as a Lifter Oil Manifold Assembly (LOMA), in combination with electrically driven solenoid valves to selectively pass oil to the switchable elements on command from an Engine Control Module (ECM). Such systems require an oil pressure control system that can maintain operational oil pressures at both a relatively low value where the switchable elements facilitate firing of all cylinders, and a relatively high value where the switchable elements de-activate firing of selected cylinders. The presence of air bubbles in the oil supply gallery or the oil control gallery can inadvertently affect the ability of the oil pressure control system to maintain the desired operational pressures, which could lead to pressure fluctuations in the oil control gallery that could cause inadvertent and undesirable switching of the switching elements.

Accordingly, it is desirable to provide an oil pressure control system for switchable valve train components for reducing pressure fluctuations in an oil control gallery sufficient to avoid inadvertent switching of switchable valve train components.

SUMMARY OF THE INVENTION

In an exemplary embodiment of the invention an oil control system includes an oil supply gallery, an oil control gallery, an oil control valve, and an oil bypass passage. The oil control valve is disposed in fluid communication between the oil supply gallery and the oil control gallery. The oil control valve has a first position that prevents flow of oil from the oil supply gallery to the oil control gallery and permits flow of oil from the oil control gallery to a downstream drain line, and a second position that permits flow of oil from the oil supply gallery to the oil control gallery and prevents flow of oil from the oil supply gallery to the drain line. The oil bypass passage is disposed in fluid communication between the oil supply gallery and the oil control gallery, and is disposed to bypass the oil control valve. The oil bypass passage has a first oil flow constriction region disposed closer to the oil supply gallery than to the oil control gallery, a second oil flow constriction region disposed closer to the oil control gallery than to the oil supply gallery, and an intermediate volume disposed between the first and second oil flow constriction regions.

In another exemplary embodiment of the invention a combination for use in a vehicle includes an internal combustion engine and an oil control system disposed in operable communication with the internal combustion engine. The oil control system includes an oil supply gallery, an oil control gallery, an oil control valve, and an oil bypass passage. The oil control valve is disposed in fluid communication between the oil supply gallery and the oil control gallery. The oil control valve has a first position that prevents flow of oil from the oil supply gallery to the oil control gallery and permits flow of oil from the oil control gallery to a downstream drain line, and a second position that permits flow of oil from the oil supply gallery to the oil control gallery and prevents flow of oil from the oil supply gallery to the drain line. The oil bypass passage is disposed in fluid communication between the oil supply gallery and the oil control gallery, and is disposed to bypass the oil control valve. The oil bypass passage has a first oil flow constriction region disposed closer to the oil supply gallery than to the oil control gallery, a second oil flow constriction region disposed closer to the oil control gallery than to the oil supply gallery, and an intermediate volume disposed between the first and second oil flow constriction regions.

In a further exemplary embodiment of the invention a vehicle includes a body, an internal combustion engine disposed within the body, and an oil control system disposed in operable communication with the internal combustion engine. The oil control system includes an oil supply gallery, an oil control gallery, an oil control valve, and an oil bypass passage. The oil control valve is disposed in fluid communication between the oil supply gallery and the oil control gallery. The oil control valve has a first position that prevents flow of oil from the oil supply gallery to the oil control gallery and permits flow of oil from the oil control gallery to a downstream drain line, and a second position that permits flow of oil from the oil supply gallery to the oil control gallery and prevents flow of oil from the oil supply gallery to the drain line. The oil bypass passage is disposed in fluid communication between the oil supply gallery and the oil control gallery, and is disposed to bypass the oil control valve. The oil bypass passage has a first oil flow constriction region disposed closer to the oil supply gallery than to the oil control gallery, a second oil flow constriction region disposed closer to the oil control gallery than to the oil supply gallery, and an intermediate volume disposed between the first and second oil flow constriction regions.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
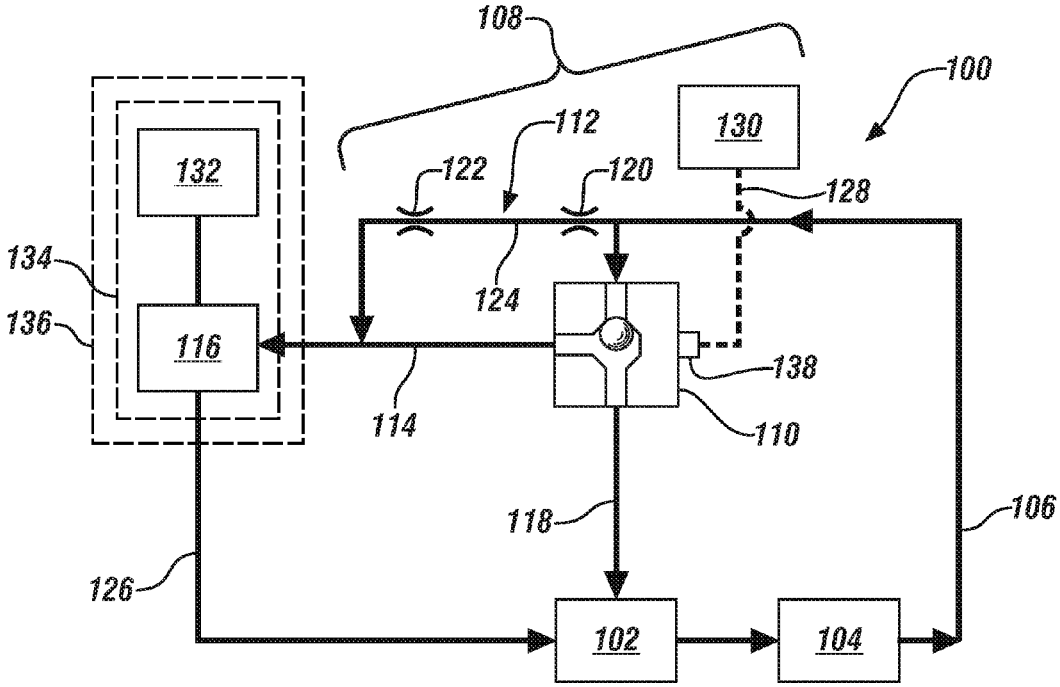
FIG. 1 depicts an oil control system for an internal combustion engine in accordance with an embodiment of the invention.

The following description is merely exemplary in nature and is not intended to limit the present disclosure, its application or uses. It should be understood that throughout the drawings, corresponding reference numerals indicate like or corresponding parts and features.

In accordance with an exemplary embodiment of the invention, an oil pressure control system for switchable valve train components (SVTCs) employs an oil bypass passage to provide a continuous flow of oil between an oil supply gallery and an oil control gallery when an oil control valve is set to prevent flow therebetween. The oil bypass passage has two spaced apart oil flow constriction regions that serve to step down the oil pressure in stages and slow down the rate of expansion of an air bubble in the oil as the air bubble and oil travel from the oil supply gallery to the oil control gallery via an intermediate volume, thereby reducing pressure oscillations in the control gallery that could inadvertently deactivate one or more of the switchable valve train components. Exemplary switchable valve train components include active fuel management (AFM) lifters, and two-step valve lifters employing hydraulic tappets disposed in operable communication with a set of switchable rocker arms, for example.

In accordance with an exemplary embodiment of the invention, and with reference to FIG. 1, an oil control system 100 for an internal combustion engine (ICE) 136 is depicted having an oil sump 102 for holding a volume of engine oil and for receiving post-circulated engine oil, and an oil pump 104 that feeds oil from the sump 102 to an oil supply gallery 106 that is used for general lubrication of the ICE 136, and for operational support of the valve deactivation control system 108, which includes an oil control valve 110 and an oil bypass passage 112, which are both in fluid communication between the oil supply gallery 106 and an oil control gallery 114. The oil control gallery 114 is in fluid communication with a set of one or more switchable valve train components (SVTCs) 116, and provides controlled oil pressure for actuation of the SVTCs 116. Each set of SVTCs 116 is disposed in operable communication with a respective set of intake and exhaust valves 132 that are associated with a particular cylinder 134 of the ICE 136 being controlled (switched). While the term cylinder is used herein in reference to a combustion chamber of an engine, it will be appreciated that the scope of the invention is not limited to a particular geometry for the combustion chamber and that any combustion chamber geometry suitable for a purpose disclosed herein is considered within the scope of the invention. For clarity and ease of illustration, FIG. 1 depicts only one deactivation control system 108 and one set of SVTCs 116 for controlling deactivation of the intake and exhaust valves 132 for a single cylinder 134 of the ICE 136. However, it will be appreciated that multiple cylinders of ICE 136 may be equally controlled using FIG. 1 as a guideline. For example, the oil supply gallery 106 can be fluidly connected to another oil circuit branch containing another valve deactivation control system (similar to 108) that is operably coupled to another set of SVTCs (similar to 116) for switching another set of intake and exhaust valves (similar to 132) of a second cylinder (similar to 134) of the ICE 136, making the oil supply gallery 106 a global oil supply gallery for all cylinders of ICE 136 that are switchable.

Figure 2A:
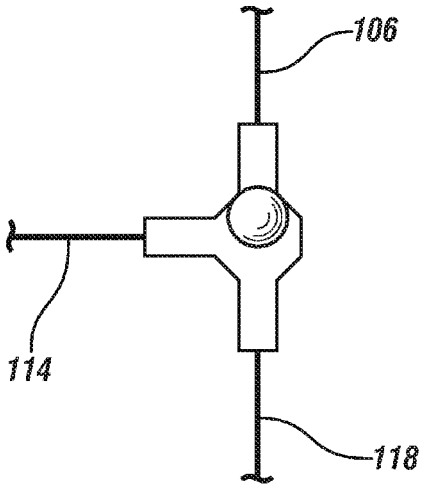
FIG. 2A depicts an oil control valve in a first position for use in accordance with an embodiment of the invention.
Figure 2B:
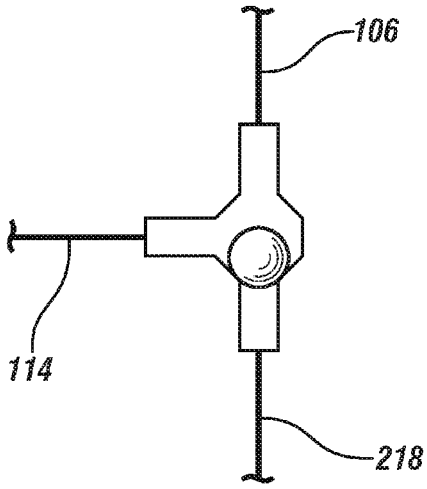
FIG. 2B depicts the oil control valve of FIG. 2A but in a second position and for use in accordance with an embodiment of the invention.

The oil control valve 110 is operable between a first position that prevents flow of oil from the oil supply gallery 106 to the oil control gallery 114 and permits flow of oil from the oil control gallery 114 to a downstream drain line 118, and a second position that permits flow of oil from the oil supply gallery 106 to the oil control gallery 114 and prevents flow of oil from the oil supply gallery 106 to the drain line 118. In an embodiment, the oil control valve 110 is a three-way oil control valve having first and second positions as depicted in FIGS. 2A and 2B, respectively.

The oil bypass passage 112 is disposed in parallel with the oil control valve 110 so that oil from the oil supply gallery 106 can bypass the oil control valve 110 to flow to the oil control gallery 114 when the oil control valve 110 is in the first position. The oil bypass passage 112 includes a first oil flow constriction region 120 disposed closer to the oil supply gallery 106 than to the oil control gallery 114, a second oil flow constriction region 122 disposed closer to the oil control gallery 114 than to the oil supply gallery 106, and an intermediate volume 124 disposed between the first and second oil flow constriction regions 120, 122. The second oil flow constriction region 122 is spaced apart from the first oil flow constriction region 120 such that a discrete air bubble when present in the oil bypass passage 112 cannot simultaneously pass through both the first and second oil flow constriction regions 120, 122. In an embodiment, the first oil flow constriction region 120 is a first bleed orifice, and the second flow constriction region 122 is a second bleed orifice, where the second bleed orifice is larger than the first bleed orifice to accommodate expansion of the air bubble as it passes from a region of relative high pressure to a region of relative low pressure. In another embodiment, the first and second oil flow constriction regions 120, 122 may be channels, tubular passages, annular spaces, or any other configuration suitable for a purpose disclosed herein.

The oil supply gallery 106 is configured to operate at an oil pressure Ps, which in an embodiment is on the order of 60 psig. The oil control gallery 114 is configured to operate at an oil pressure Pc, which in an embodiment is operable from a nominal pressure above 0 psig up to 60 psig (more generally, 0 psig<Pc<=Ps). In an embodiment, the lower boundary of Pc is on the order of 2 psig. However, in accordance with another embodiment of the invention, which will be discussed in more detail below in connection with FIG. 3, the lower boundary of Pc is on the order of 5 psig. While certain oil pressures are discussed herein, it will be appreciated that these pressures are exemplary only and are non-limiting, as other pressure levels may be considered suitable for a purpose disclosed herein without detracting from the scope of the invention.

With respect to the embodiment depicted in FIG. 1, when the oil control valve 110 is in the first position, Ps is high at about 60 psig, and Pc is low at about 2 psig. As such, oil attempts to flow from the oil supply gallery 106 to the oil control gallery 114 via the oil bypass passage 112 and through the first and second oil flow constriction regions 120, 122. As discussed above, the second oil flow constriction region 122 is spaced apart from the first oil flow constriction region 120 such that an air bubble when present in the oil bypass passage 112 cannot simultaneously pass through both the first and second oil flow constriction regions 120, 122. Also, the first and second oil flow constriction regions 120, 122 are sized such that an oil pressure Pi in the intermediate volume 124 is stepped down from the oil pressure Ps (60 psig), but is not stepped down all the way to the oil pressure Pc (2 psig). In general, Pc<Pi<Ps. In an embodiment, the first and second oil flow constriction regions 120, 122 are sized such that Pi is equal to or about equal to Ps/2, which in the above described example would result in Pi being on the order of 30 psig when the oil control valve 110 is in the first position. With the oil control valve 110 being in the first position, Pc is too low to actuate the SVTCs 116 since the oil pressure required for switching the SVTCs 116 is on the order of 15 psig, which results in the SVTCs 116 being disposed and configured to enable actuation of an associated set of intake and exhaust valves 132 for the particular cylinder 134 of the ICE 136 being controlled. By causing the oil in the oil bypass passage 112 to flow through two flow constriction regions 120, 122, pressure fluctuations in the oil control gallery 114 are limited so as not to exceed the switching threshold, on the order of 15 psig, of the switchable elements of the SVTCs 116, thereby avoiding inadvertent deactivation of the associated intake and exhaust valves 132. Pressure fluctuations in the oil control gallery 114 for a system having a single orifice are possible when an air bubble in the oil flows through the single orifice, because the flow rate of air through the orifice is greater than the corresponding flow rate of oil, in conjunction with the rapid expansion of the air bubble as it passes from a region of relatively high pressure (Ps) to a region of relatively low pressure (Pc).

When the oil control valve 110 is in the second position, both Ps and Pc are high at about 60 psig. Since both ends of the oil bypass passage 112 are at substantially the same pressure, with the exception of some minimal pressure drop across the oil control valve 110, there is no driving force to produce an oil flow through the oil bypass passage 112. Under this condition Pc is high enough, at or above the switching pressure 15 psig, to actuate the SVTCs 116, resulting in the SVTCs 116 being disposed and configured to deactivate, i.e., disable actuation of, the set of intake and exhaust valves 132 for the particular cylinder 134 of the ICE 136 being controlled.

When the oil control valve 110 is in the first position (FIG. 2A), Pc low, oil in the oil control gallery 114 passes to the sump 102 via the drain line 118. When the oil control valve 110 is in the second position (FIG. 2B), Pc high, oil in the oil control gallery 114 passes to the sump 102 via leakage paths around the SVTCs 116 and the downstream drain line 126.

In an embodiment, the oil control valve 110 is solenoid actuated with a solenoid 138 receiving a control signal 128 from an electronic control module (ECM) 130 associated with the ICE 136 being controlled. The ECM 130, via the solenoid 138 and control signal 128, facilitates selective switching of the oil control valve 110 between the first and second positions on command. For example, under heavy engine loading, ECM 130 facilitates switching of all of the oil control valves 110 to the first position so that all of the intake and exhaust valves are functional and all of the cylinders of the engine actively provide power. And under light engine loading, ECM 130 facilitates switching of a specified number of oil control valves 110 to the second position so that only a subset of all cylinders of the engine actively provide power, the intake and exhaust valves of the other cylinders being deactivated.

The foregoing description as it applies to FIG. 1 relates primarily to SVTCs 116 having AFM lifters, where Pc is controlled to go low to a pressure of about 2 psig when the oil control valve 110 is in the first position. In a two-step valve lift application where the SVTCs 116 employ hydraulic tappets disposed in operable communication with switchable rocker arms, the low value of Pc is controlled to go low to a pressure of about 5 psig when the oil control valve 110 is in the first position, which will now be discussed with reference to FIG. 3 where like elements are numbered alike.

Figure 3:
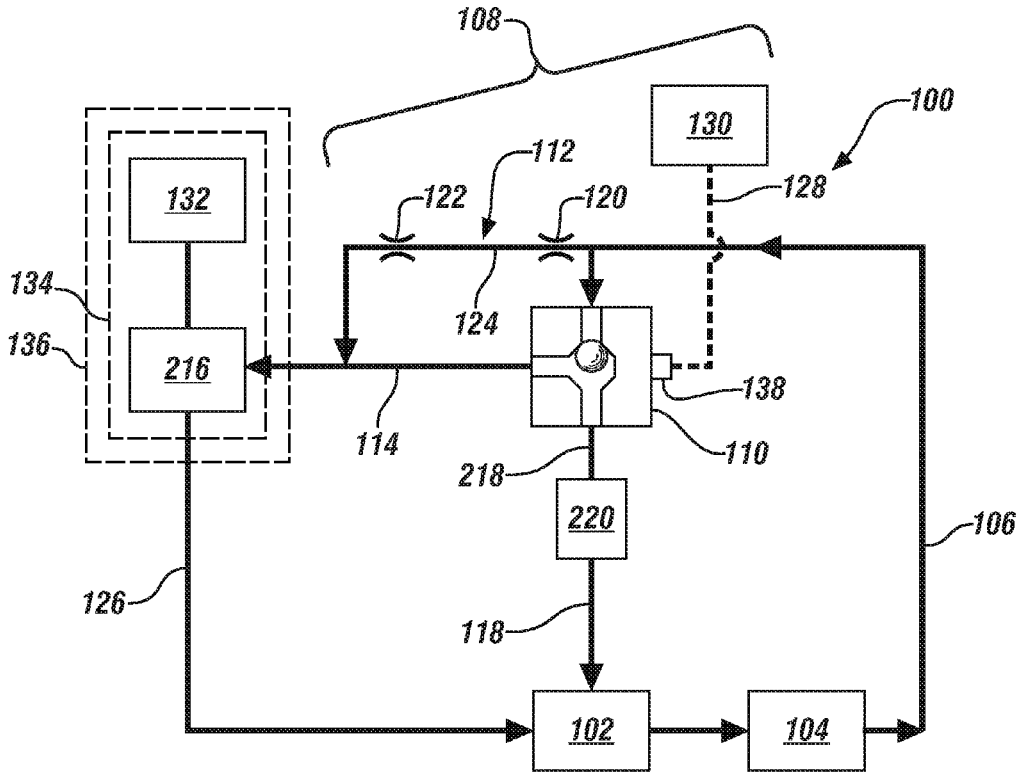
FIG. 3 depicts an alternative oil control system to that of FIG. 1 for an internal combustion engine in accordance with an embodiment of the invention.

FIG. 3 depicts an oil control system 200 similar to that of oil control system 100 of FIG. 1, but where the SVTC's 216 have hydraulic tappets and switchable rocker arms. In the two-step valve lift application of FIG. 3, a pressure relief valve 220 is disposed in fluid communication between the oil control valve 110 and the sump 102 via drain line 218 to maintain the pressure Pc in the oil control gallery 114 above a threshold value, such as 5 psig, when the oil control valve 110 is in the first position. Pressure relief valve 220 drains to the sump 102 via drain line 118. Other operational characteristics associated with the structure of FIG. 3, such as switching of the SVTCs 216 when the oil control valve 110 switches between the first position (FIG. 2A) and the second position (FIG. 2B), follow the same description discussed above in connection with the structure of FIG. 1.

Figure 4:
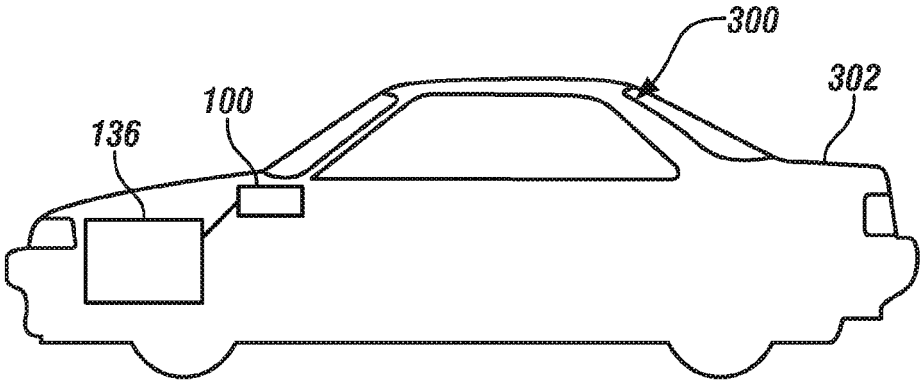
FIG. 4 depicts in block diagram form a vehicle for use in accordance with an embodiment of the invention.
Figure 5A:
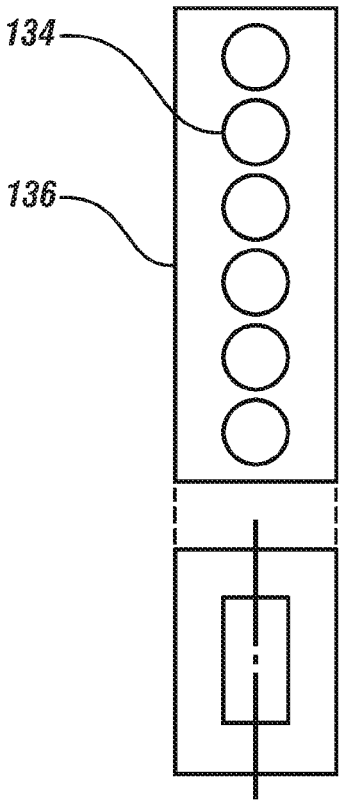
FIG. 5A depicts in block diagram form an in-line 6-cylinder engine for use in accordance with an embodiment of the invention.
Figure 5B:
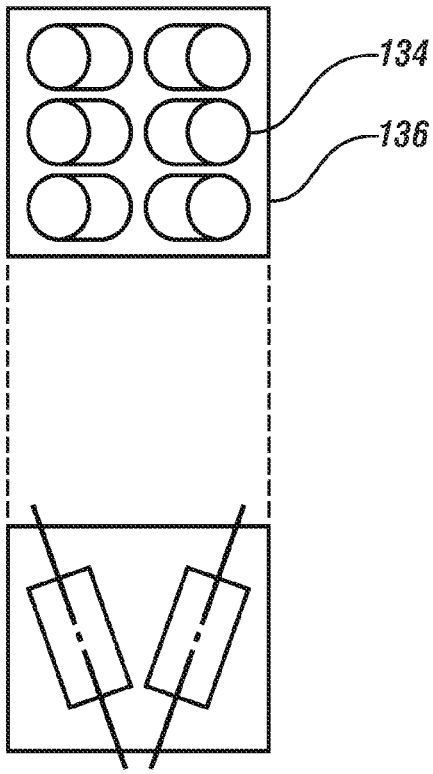
FIG. 5B depicts in block diagram form a V6 engine for use in accordance with an embodiment of the invention.

In view of the foregoing, and with reference now to FIG. 4, it will be appreciated that the ICE 136 being controlled by the oil control system 100 in the manner described above may be disposed within a body 302 of a vehicle 300, which may be any vehicle, such as but not limited to a car, a sport utility vehicle, a truck, a bus or a commercial vehicle, for example, that is operably suited to be propelled by the switchable ICE 136 in accordance with an embodiment of the invention. With reference to FIG. 5A and FIG. 5B, an embodiment of the ICE 136 comprises a plurality of combustion chambers 134 that may be arranged in an in-line configuration, or an opposed-cylinder configuration such as a V-type configuration. In an embodiment the in-line configuration may be an 14 configuration (4 cylinders arranged in-line), an 15 configuration (5 cylinders arranged in-line), an 16 configuration (6 cylinders arranged in-line) as depicted in FIG. 5A, a V6 configuration (3 cylinders arranged on each side of the engine opposing each other in a V-type orientation) as depicted in FIG. 5B, or a V8 configuration (4 cylinders arranged on each side of the engine opposing each other in a V-type orientation), for example. However, it will be appreciated that the scope of the invention is not limited to only 4, 5, 6 or 8 cylinders, as other engines having a different number of cylinders, such as 10 or 12 for example, are considered to be within the scope of the invention.

In view of the foregoing, it will be appreciated that one or more embodiments of the invention may include one or more of the following advantages: an oil pressure control system for switchable valve train components that reduces pressure fluctuations in an oil control gallery sufficient to avoid inadvertent switching of switchable valve train components; an oil bypass passage, configured to provide a continuous flow of oil between an oil supply gallery and an oil control gallery when an oil control valve is set to prevent flow therebetween, having two bleed orifices and an intermediate volume between the two orifices, where the intermediate volume is large enough to prevent a single air bubble from simultaneously passing through both orifices; improved resistance to plugging by using two bleed orifices with each orifice having a diameter larger than a diameter of a single orifice in a single-orifice-application; and, improved control of the parasitic oil flow rate through the oil control gallery by using two bleed orifices in series that steps down the oil pressure from the oil supply gallery to the oil control gallery in stages.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. An oil control system, comprising:

an oil supply gallery;

an oil control gallery;

an oil control valve disposed in fluid communication between the oil supply gallery and the oil control gallery, the oil control valve having a first position that prevents flow of oil from the oil supply gallery to the oil control gallery and permits flow of oil from the oil control gallery to a downstream drain line, and a second position that permits flow of oil from the oil supply gallery to the oil control gallery and prevents flow of oil from the oil supply gallery to the drain line; and an oil bypass passage disposed in fluid communication between the oil supply gallery and the oil control gallery, and disposed to bypass the oil control valve, the oil bypass passage having a first oil flow constriction region disposed closer to the oil supply gallery than to the oil control gallery, a second oil flow constriction region disposed closer to the oil control gallery than to the oil supply gallery, and an intermediate volume disposed between the first and second oil flow constriction regions.

2. The oil control system of claim 1, wherein the oil supply gallery is configured to operate at an oil pressure Ps, and the oil control gallery is configured to operate at an oil pressure Pc, wherein Pc is operable within the range (0 psig<Pc<=Ps), and further wherein:

when the oil control valve is in the first position, the first and second oil flow constriction regions are configured to produce an oil pressure Pi in the intermediate volume wherein Pi<Ps, and Pi>Pc.

3. The oil control system of claim 2, wherein Pi comprises Ps/2.

4. The oil control system of claim 1, wherein the first oil flow constriction region comprises a first bleed orifice, and the second flow constriction region comprises a second bleed orifice, the second bleed orifice being larger than the first bleed orifice.

5. The oil control system of claim 1, wherein the second oil flow constriction region is spaced apart from the first oil flow constriction region such that an air bubble when present in the oil bypass passage cannot simultaneously pass through both the first and second oil flow constriction regions.

6. The oil control system of claim 1, wherein the oil control valve comprises a three-way oil control valve.

7. The oil control system of claim 1, further comprising:

a set of one or more switchable valve train components (SVTCs) disposed in operable communication with one or more intake and/or exhaust valves, and disposed in fluid communication with and downstream of the oil control gallery, such that when the oil control valve is in the first position the set of SVTCs are disposed and configured to enable actuation of the one or more intake and/or exhaust valves, and when the oil control valve is in the second position the SVTCs are disposed and configured to disable actuation of the one or more intake and/or exhaust valves.

8. The oil control system of claim 7, wherein:

the set of SVTCs comprises a set of cylinder deactivation lifters.

9. The oil controls system of claim 7, wherein:

the set of SVTCs comprises a set of hydraulic tappets disposed in operable communication with a set of switchable rocker arms disposed in operable communication with a respective set of intake valves.

10. The oil control system of claim 7, further comprising:

an oil sump; and an oil pump, the oil pump being disposed in fluid communication with the oil sump and the oil supply gallery to pump oil from the oil sump to the oil supply gallery;

wherein the drain line from the oil control valve is in fluid communication with and upstream of the oil sump;

wherein the SVTCs are in fluid communication with and upstream of the oil sump.

11. The oil control system of claim 1, further comprising:

an electronic control module (ECM) disposed in signal communication with the oil control valve, and operable to facilitate switching of the oil control valve between the first and second positions on demand.

12. The oil control system of claim 9, further comprising:

a pressure relief valve disposed in fluid communication between the oil control valve and the sump, the pressure relief valve configured to maintain the pressure Pc in the oil control gallery above a threshold value when the oil control valve is in the first position.

13. A combination for use in a vehicle, the combination comprising:

an internal combustion engine; and an oil control system disposed in operable communication with the internal combustion engine, the oil control system comprising:

an oil supply gallery;

an oil control gallery;

an oil control valve disposed in fluid communication between the oil supply gallery and the oil control gallery, the oil control valve having a first position that prevents flow of oil from the oil supply gallery to the oil control gallery and permits flow of oil from the oil control gallery to a downstream drain line, and a second position that permits flow of oil from the oil supply gallery to the oil control gallery and prevents flow of oil from the oil supply gallery to the drain line; and an oil bypass passage disposed in fluid communication between the oil supply gallery and the oil control gallery, and disposed to bypass the oil control valve, the oil bypass passage having a first oil flow constriction region disposed closer to the oil supply gallery than to the oil control gallery, a second oil flow constriction region disposed closer to the oil control gallery than to the oil supply gallery, and an intermediate volume disposed between the first and second oil flow constriction regions.

14. The combination of claim 13, wherein:

the internal combustion engine comprises a plurality of combustion chambers arranged in an in-line configuration.

15. The combination of claim 13, wherein:

the internal combustion engine comprises a plurality of combustion chambers arranged in a V-type configuration.

16. The combination of claim 13, wherein;

the internal combustion engine comprises a plurality of combustion chambers arranged in an opposed-cylinder configuration.

17. A vehicle, comprising:

a body;

an internal combustion engine disposed within the body; and an oil control system disposed in operable communication with the internal combustion engine, the oil control system comprising:

an oil supply gallery;

an oil control gallery;

an oil control valve disposed in fluid communication between the oil supply gallery and the oil control gallery, the oil control valve having a first position that prevents flow of oil from the oil supply gallery to the oil control gallery and permits flow of oil from the oil control gallery to a downstream drain line, and a second position that permits flow of oil from the oil supply gallery to the oil control gallery and prevents flow of oil from the oil supply gallery to the drain line; and an oil bypass passage disposed in fluid communication between the oil supply gallery and the oil control gallery, and disposed to bypass the oil control valve, the oil bypass passage having a first oil flow constriction region disposed closer to the oil supply gallery than to the oil control gallery, a second oil flow constriction region disposed closer to the oil control gallery than to the oil supply gallery, and an intermediate volume disposed between the first and second oil flow constriction regions.

* * * * *